United States Patent [19]

Roller

[11] Patent Number: 4,589,647

[45] Date of Patent: May 20, 1986

[54] TOP VACUUM CORRUGATION FEEDER WITH A VALVELESS FEEDHEAD

[75] Inventor: George J. Roller, Penfield, N.Y.

[73] Assignee: Xerox Corporation, Stamford, Conn.

[21] Appl. No.: 676,441

[22] Filed: Nov. 29, 1984

[51] Int. Cl.[4] ..... B65H 3/12

[52] U.S. Cl. ..... 271/94; 271/34

[58] Field of Search ..... 271/94, 96, 98, 161, 271/34

[56] References Cited

U.S. PATENT DOCUMENTS

| | | | |
|---|---|---|---|
| 2,895,552 | 7/1959 | Pomper et al. | 164/68 |
| 2,970,834 | 2/1961 | Martin et al. | 271/26 |
| 2,979,329 | 4/1961 | Cunningham | 271/29 |
| 3,034,784 | 5/1962 | Lopez | 271/29 |
| 3,171,647 | 3/1965 | Bishop | 271/94 X |
| 3,260,520 | 7/1966 | Sugden | 271/94 |
| 3,424,453 | 1/1969 | Halbert | 271/35 |
| 3,614,089 | 10/1971 | Van Auken | 271/94 |
| 3,649,002 | 3/1972 | Burkhardt | 271/26 R |
| 4,003,567 | 1/1977 | Berger, Jr. et al. | 271/12 |
| 4,157,177 | 6/1979 | Strecker | 271/197 |
| 4,181,298 | 1/1980 | Capdeboseq | 271/5 |
| 4,268,025 | 5/1981 | Murayoshi | 271/112 |
| 4,269,406 | 5/1981 | Hamlin | 271/108 |
| 4,310,151 | 1/1982 | Fujimoto | 271/11 |
| 4,401,301 | 8/1983 | Hayskar | 271/96 |
| 4,418,905 | 12/1983 | Garavuso | 271/98 |
| 4,451,028 | 5/1984 | Holmes et al. | 271/11 |

FOREIGN PATENT DOCUMENTS 2029375A 8/1978 United Kingdom .

OTHER PUBLICATIONS

IBM Technical Disclosure Bulletin, vol. 6, No. 2, 1963, pp. 32, 33, "Document Feeder and Separator", T. H. Anderson and J. C. Baker.

*Primary Examiner*—Richard A. Schacher
*Attorney, Agent, or Firm*—William A. Henry, II

[57] ABSTRACT

A top vacuum corrugation feeder is disclosed that employs a vacuum feedhead working in conjunction with an air knife to feed sheets from the top of a stack. The feedhead is valveless and has a vacuum applied thereto during the entire feed cycle in order to increase reliability and decrease minimum feed speed.

8 Claims, 3 Drawing Figures

TOP VACUUM CORRUGATION FEEDER WITH A VALVELESS FEEDHEAD

BACKGROUND OF THE INVENTION

This invention relates to an electrophotographic printing machine, and more particularly, concerns an improved top vacuum corrugation feeder for such a machine.

Present high speed xerographic copy reproduction machines produce copies at a rate in excess of several thousand copies per hour, therefore, the need for a sheet feeder to feed cut copy sheets to the machine in a rapid, dependable manner has been recognized to enable full utilization of the reproduction machine's potential copy output. In particular, for many purely duplicating operations, it is desired to feed cut copy sheets at very high speeds where multiple copies are made of an original placed on the copying platen. In addition, for many high speed copying operations, a document handler to feed documents from a stack to a copy platen of the machine in a rapid dependable manner has also been reorganized to enable full utilization of the machine's potential copy output. These sheet feeders must operate flawlessly to virtually eliminate the risk of damaging the sheets and generate minimum machine shutdowns due to uncorrectable misfeeds or sheet multifeeds. It is in the initial separation of the individual sheets from the sheet stack where the greatest number of problems occur.

Since the sheets must be handled gently but positively to assure separation without damage through a number of cycles, a number of separators have been suggested such as friction rolls or belts used for fairly positive document feeding in conjunction with a retard belt, pad, or roll to prevent multifeeds. Vacuum separators such as sniffer tubes, rocker type vacuum rolls, or vacuum feed belts have also been utilized.

While the friction roll-retard systems are very positive, the action of the retard member, if it acts upon the printed face can cause smearing or partial erasure of the printed material on the document. With single sided documents if the image is against the retard mechanism, it can be smeared or erased. On the other hand, if the image is against the feed belt it smears through ink transfer and offset back to the paper. However, with documents printed on both sides the problem is compounded. Additionally, the reliable operation of friction retard feeders is highly dependent on the relative frictional properties of the paper being handled. This cannot be controlled in a document feeder.

One of the sheet feeders best known for high speed operation is the top vacuum corrugation feeder with front air knife. In this system, a vacuum plenum with a plurality of friction belts arranged to run over the vacuum plenum is placed at the top of a stack of sheets in a supply tray. At the front of the stack, an air knife is used to inject air into the stack to separate the top sheet from the remainder of the stack. In operation, air is injected by the air knife toward the stack to separate the top sheet, the vacuum pulls the separated sheet up and acquires it. Following acquisition, the belt transport drives the sheet forward off the stack of sheets. In this configuration, separation of the next sheet cannot take place until the top sheet has cleared the stack. In this type of feeding system every operation takes place in succession or serially and therefore the feeding of subsequent sheets cannot be started until the feeding of the previous sheet has been completed. In addition, in this type of system the air knife may cause the second sheet to vibrate independent of the rest of the stack in a manner referred to as "flutter". When the second sheet is in this situation, if it touches the top sheet, it may tend to creep forward slightly with the top sheet. The air knife then may drive the second sheet against the first sheet causing a shingle or double feeding of sheets. Also, current top and bottom vacuum corrugation feeders utilize a valved vacuum feedhead, e.g., U.S. Pat. No. 4,269,406 which is included herein by reference. At the appropriate time during the feed cycle the valve is actuated, establishing a flow and hence a negative pressure field over the stack top or bottom if a bottom vacuum corrugation feeder is employed. This field causes the movement of the top sheet(s) to the vacuum feedhead where the sheet is then transported to the take away rolls. Once the sheet feed edge is under control of the take away rolls, the vacuum is shut off. The trail edge of this sheet exiting the feedhead area is the criteria for again activating the vacuum valve for the next feeding.

PRIOR ART

U.S. Pat. No. 2,979,329 (Cunningham) describes a sheet feeding mechanism useful for both top and bottom feeding of sheets wherein an oscillating vacuum chamber is used to acquire and transport a sheet to be fed. In addition, an air blast is directed to the leading edge of a stack of sheets from which the sheet is to be separated and fed to assist in separating the sheets from the stack.

U.S. Pat. No. 3,424,453 (Halbert) illustrates a vacuum sheet separator feeder with an air knife wherein a plurality of feed belts with holes are transported about a vacuum plenum and pressurized air is delivered to the leading edge of the stack of sheets. This is a bottom sheet feeder.

U.S. Pat. No. 2,895,552 (Pomper et al.) illustrates a vacuum belt transport and stacking device wherein sheets which have been cut from a web are transported from the sheet supply to a sheet stacking tray. Flexible belts perforated at intervals are used to pick up the leading edge of the sheet and release the sheet over the pile for stacking.

U.S. Pat. No. 4,157,177 (Strecker) illustrates another sheet stacker wherein a first belt conveyor delivers sheets in a shingled fashion and the lower reach of a second perforated belt conveyor which is above the top of the stacking magazine attracts the leading edge of the sheets. The device has a slide which limits the effect of perforations depending on the size of the shingled sheet.

U.S. Pat. No. 4,268,025 (Murayoshi) describes a top sheet feeding apparatus wherein a sheet tray has a vacuum plate above the tray which has a suction hole in its bottom portion. A feed roll in the suction hole transports a sheet to a separating roll and a frictional member in contact with the separating roll.

U.S. Pat. No. 4,418,905 (Garavuso) shows a bottom vacuum corrugation feeding system.

U.S. Pat. No. 4,451,028 (Holmes et al.) discloses a top feed vacuum corrugation feeding system that employs front and back vacuum plenums.

The above-mentioned patents are included herein by reference to the extent necessary to practice the present invention.

SUMMARY OF THE INVENTION

It is an object of the present invention to provide an improved sheet separator feeder.

It is an additional object of the present invention to provide an improved high speed sheet separator feeder with significant noise reduction.

It is an additional object of the present invention to provide a more efficient and more reliable high speed sheet separator feeder that requires less electrical control.

It is an additional object of the present invention to provide a top vacuum corrugation sheet feeder in which the vacuum to the vacuum plenum is ON continuously during the feed cycle.

These and other objects are attained with a sheet feeding apparatus comprising a sheet stack support tray, a vacuum plenum chamber positioned over the front of a stack of sheets when sheets are placed in the tray with the vacuum plenum chamber having a negative pressure applied thereto at all times during a feed cycle, sheet transport means associated with said vacuum plenum to transport the sheets acquired by said vacuum plenum in a forward direction out of the sheet stack support tray, and air knife means positioned adjacent the front of said stack of sheets for applying a positive pressure to the sheet stack in order to separate the uppermost sheet from the rest of the stack.

For a better understanding of the invention as well as other objects and further features thereof, reference is made to the following drawings and descriptions.

DESCRIPTION OF THE PREFERRED EMBODIMENT

While the present invention will be described hereinafter in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
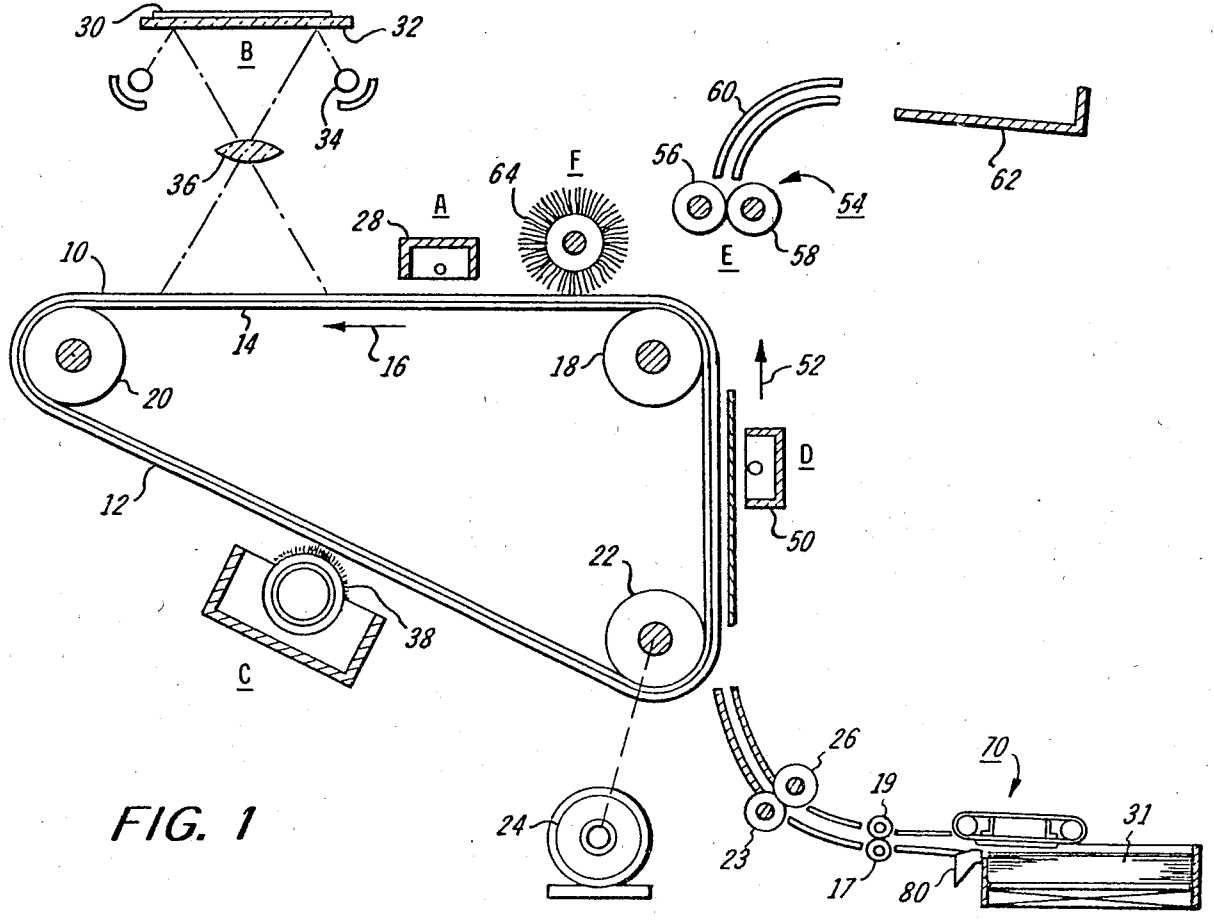
FIG. 1 is a schematic elevational view of an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the top feed vacuum corrugation feeder method and apparatus of the present invention therein. It will become evident from the following discussion that the sheet feeding system disclosed herein is equally well suited for use in a wide variety of devices and is not necessarily limited to its application to the particular embodiment shown herein. For example, the apparatus of the present invention may be readily employed in non-xerographic environments and substrate transportation in general.

Inasmuch as the art of electrophotographic printing is well known, the various processing stations employed in the FIG. 1 printing machine will be shown hereinafter schematically and the operation described briefly with reference thereto.

As shown in FIG. 1, the electrophotographic printing machine employs a belt 10 having a photoconductive surfaced 12 deposited on a conductive substrate 14. Preferably, photoconductive surface 12 is made from a selenium alloy with conductive substrate 14 being made from an aluminum alloy. Belt 10 moves in the direction of arrow 16 to advance successive portions of photoconductive surface 12 sequentially through the various processing stations disposed about the path of movement thereof. Belt 10 is entrained around stripper roller 18, tension roller 20, and drive roller 22.

Drive roller 22 is mounted rotatably in engagement with belt 10. Roller 22 is coupled to a suitable means such as motor 24 through a belt drive. Motor 24 rotates roller 22 to advance belt 10 in the direction of arrow 16. Drive roller 22 includes a pair of opposed spaced flanges or edge guides (not shown). Preferably, the edge guides are circular members or flanges.

Belt 10 is maintained in tension by a pair of springs (not shown), resiliently urging tension roller 20 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 28, charges photoconductive surface 12 of the belt 10 to a relatively high, substantially uniform potential.

Next, the charged portion of photoconductive surface 12 is advanced through exposure station B. At exposure station B, an original document 30 is positioned face down upon transparent platen 32. Lamps 34 flash light rays onto original document 30. The light rays reflected from the original document 30 are transmitted through lens 36 from a light image thereof. The light image is projected onto the charged portion of the photoconductive surface 12 to selectively dissipate the charge thereon. This records an electrostatic latent image on photoconductive surface 12 which corresponds to the information areas contained within original document 30.

Thereafter, belt 10 advances the electrostatic latent image recorded on photoconductive surface 12 to development station C. At development station C, a magnetic brush developer roller 38 advances a developer mix into contact with the electrostatic latent image. The latent image attracts the toner particles from the carrier granules forming a toner powder image on photoconductive surface 12 of belt 10.

Belt 10 then advances the toner powder image to transfer station D. At transfer station D, a sheet of support material is moved into contact with the toner powder image. The sheet support material is advanced toward transfer station D by top vacuum corrugation feeder 70. Preferably, the feeder includes an air knife 80 which floats a sheet 31 up to where it is grabbed by the suction force from vacuum plenum 75. A perforated feed belt 71 then forwards the now separated sheet for further processing, i.e., the sheet is directed through rollers 17, 19, 23 and 26 into contact with the photoconductive surface 12 of belt 10 in a timed sequence by suitable conventional means so that the toner powder image developed thereon synchronously contacts the advancing sheet of support material at transfer station D.

Transfer station D includes a corona generating device 50 which sprays ions onto the backside of a sheet passing through the station. This attracts the toner powder image from the photoconductive surface 12 to the sheet and provides a normal force which causes photoconductive surface 12 to take over transport of the advancing sheet of support material. After transfer, the sheet continues to move in the direction of arrow 52 onto a conveyor (not shown) which advances the sheet to fusing station E.

Fusing station E includes a fuser assembly, indicted generally by the reference number 54, which permanently affixes the transferred toner powder image to the substrate. Preferably, fuser assembly 54 includes a heated fuser roller 56 and a backup roller 58. A sheet passes between fuser roller 56 and backup roller 58 with the toner powder image contacting fuser roller 56. In this manner, the toner powder image is permanently affixed to the sheet. After fusing, chute 60 guides the advancing sheet to catch tray 62 for removal from the printing machine by the operator.

Invariably, after the sheet support material is separated from the photoconductive surface 12 of belt 10, some residual particles remain adhering thereto. These residual particles are removed from photoconductive surface 12 at cleaning station F. Cleaning station F includes a rotatably mounted brush 64 in contact with the photoconductive surface 12. The particles are cleaned from photoconductive surface 12 by the rotation of brush 64 in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient to illustrate the general operation of an electrostatographic machine.

Figure 2:
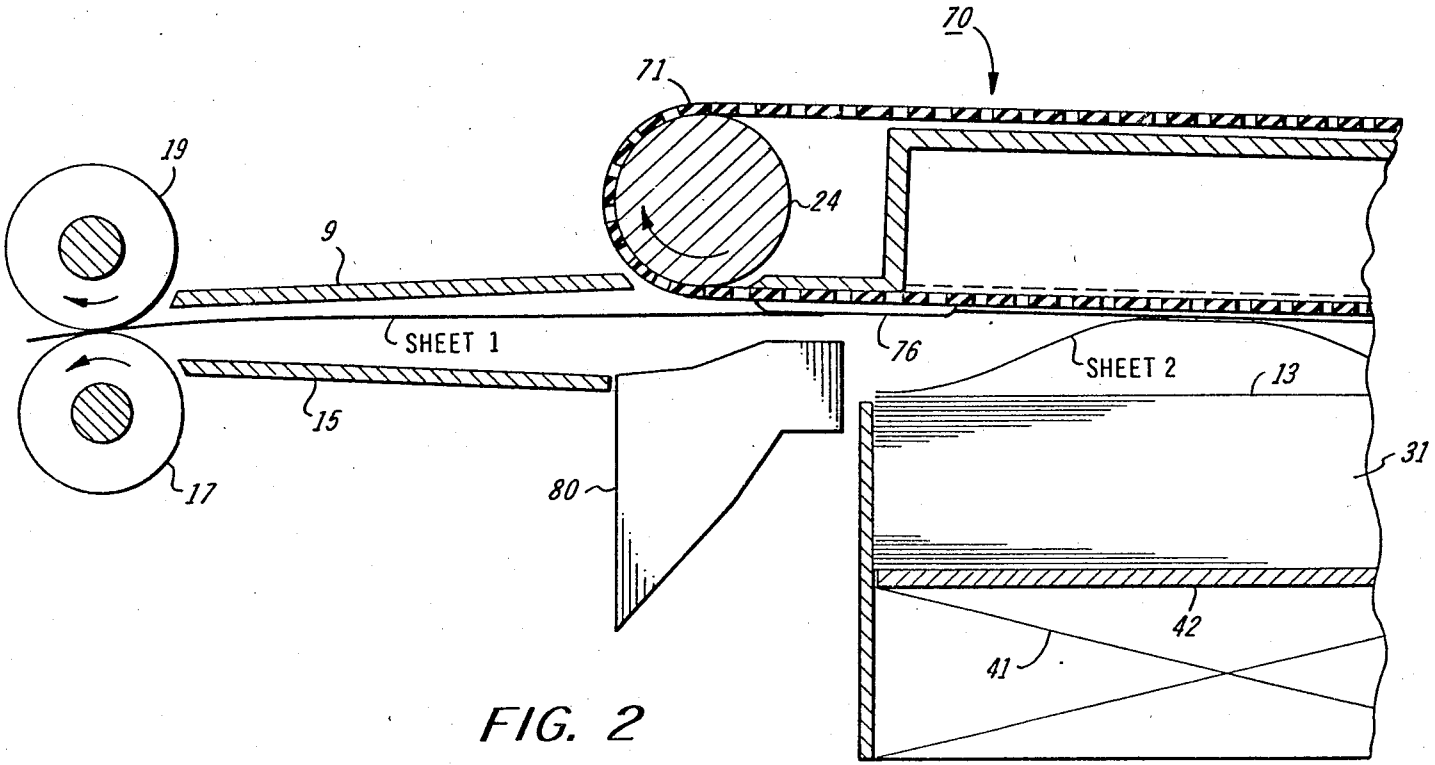
FIG. 2 is an enlarged cross-sectional view of the exemplary feeder in FIG. 1 which employs the present invention.
Figure 3:
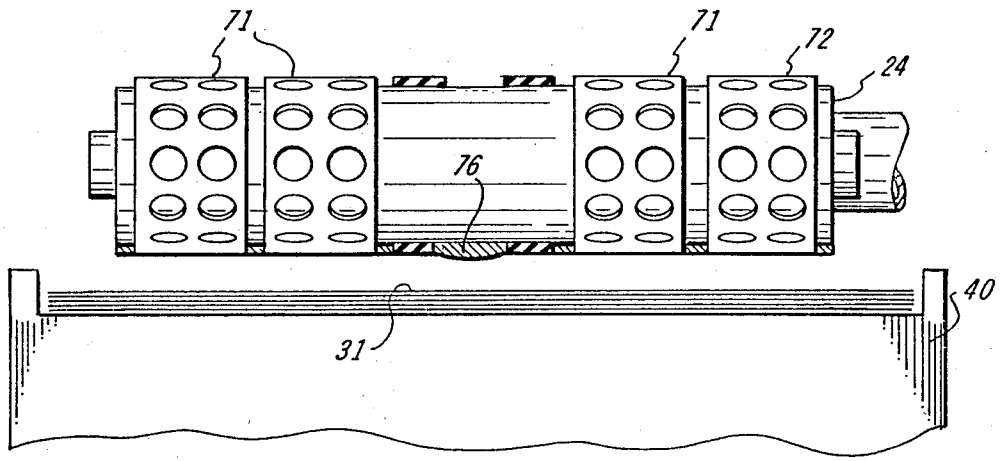
FIG. 3 is a partial front end view of the paper tray shown in FIG. 2.

Referring now to a particular aspect of the present invention, FIGS. 2 and 3 show a system employing the present invention in a copy sheet feeding mode. Alternatively, or in addition, the sheet feeder may be mounted for feeding document sheets to the platen of a printing machine. The sheet feeder is provided with a conventional elevator mechanism 41 for raising and lowering either tray 40 or a platform 42 within tray 40. Ordinarly, a drive motor is actuated to move the sheet stack support platform 42 vertically by a stack height sensor positioned above the rear of the stack when the level of sheets relative to the sensor falls below a first predetermined level. The drive motor is deactuated by the stack height sensor when the level of the sheets relative to the sensor is above a predetermined level. In this way, the level of the top sheet in the stack of sheets may be maintained within relatively narrow limits to assure proper sheet separation, acquisition and feeding.

Vacuum corrugation feeder 70 and a vacuum plenum 75 are positioned over the front end of a tray 40 having copy sheets 31 stacked therein. Belts 71 are entrained around drive rollers 24 as well as plenum 75. Belts 71 could be made into a single belt if desired. Perforations 72 in the belts allow a suitable vacuum source (not shown) to apply a vacuum through plenum 75 and belts 71 to acquire sheets 31 from stack 13. Air knife 80 with nozzle 82 applies a positive pressure to the front of stack 13 to separate the top sheet in the stack and enhance its acquisition by vacuum plenum 75. A suitable air knife that could be used in the present invention is disclosed incommonly assigned U.S. Pat. No. 4,418,905 entitled sheet Feeding Apparatus, and is incorporated herein by reference. Corrugation rail 76 is attached or molded into the underside of plenum 75 and causes sheets acquired by the vacuum plenum to bend during corrugation so that if a second sheet is still sticking to the sheet having been acquired by the vacuum plenum, the corrugation will cause the second sheet to detack and fall back into the tray. A sheet captured on belts 71 is forwarded through baffles 9 and 15 and into forwarding drive rollers 17 and 19 for transport to transfer station D.

In order to improve sheet acquisition, increase reliability and decrease minimum feed speed, and in accordance with the present invention, vacuum plenum 75 is equipped with a negative pressure source that is ON continuously during the feed cycle, with the only criteria for sheet feeding being that the motion of vacuum feedhead 70 is ceased prior to the trail edge of the acquired sheet exposing all of the vacuum ports. The next sheet is then acquired in a "travelling wave" fashion as shown in FIG. 2. This improved feeding scheme affords a reduction in noise due to the elimination of the valve associated with cutting the vacuum means ON and OFF. Also, increased reliability/decreased minimum feed speed is obtained, i.e., for given minimum required sheet acquisition and separation times, the removal of the valve from the vacuum system allows increased available acquisition/separation time per feed cycle and/or lower required minimum feed speeds. In addition, the removal of the valve from the vacuum system increases component reliability since no value is required to actuate every feed cycle and electrical control is decreased because with no valve required in the vacuum system the required valve component input/output is eliminated. It should be understood that the valveless vacuum feedhead of the present invention is equally adaptable to either bottom or top vacuum corrugation feeders.

As can be seen in FIG. 2, the ripple in sheet 2 makes for a more reliable feeder since the concavity of the sheet caused by continuously operating vacuum plenum 75 will increase the unbuckling of sheet 3 from sheet 2. Sheet 3 will have a chance to settle down against the stack before sheet 2 is fed since air knife 80 has been turned off. Belts 71 are stopped just before sheet 1 uncovers the vacuum plenum completely in order to enhance the dropping of any sheets that are tacked to sheet 2 back down upon the stack and to feed the sheets in time with images produced on the photoreceptor. When a signal is received from a conventional controller to feed another sheet, belts 71 are turned in a clockwise direction to feed sheet 2. Knife 80 is also turned ON and applies air pressure to the front of the stack to insure separation of sheet 2 from any other sheets and assist the vacuum plenum in lifting the front end of the sheet up against corrugation rail 76 which is an additional means of insuring against multi-sheet feeding. Lightweight flimsy sheet feeding is enhanced with this method of feeding since sheet 2 is easily adhered to the vacuum plenum while sheet 1 is being fed by transport rollers 17 and 19. Also, gravity will conform the front and rear portions of sheet 2 against the stack while the concavity produced in the sheet by the vacuum plenum remains.

Referring more particularly to FIG. 3, there is disclosed a plurality a feed belts 71 supported for movement on rollers. Spaced within the run of belts 71 there is provided a vacuum plenum 75 having an opening therein adapted for cooperation with perforations 72 in the belts to provide a vacuum for pulling the top sheet in the stack onto the belts 71. The plenum is provided with a projecting portion 76 so that upon capture of the top sheet in the stack by the belts a corrugation will be produced in the sheet. Thus, the sheet is corrugated in a double valley configuration. The flat surfaces of the vacuum belts on each side of the projecting portion of the vacuum plenum generates a region of maximum stress in the sheet which varies with the beam strength of the sheet. In the unlikely event more than one sheet is pulled to the belts, second sheet resists the corrugation action, thus gaps are opened between sheets one and two which extend to their lead edges. The gaps and channels reduce the vauum levels between sheets one and two due to porosity in sheet one and provide for entry of the separating air flow of the air knife 80.

By suitable valving and controls, it is desirable to provide a delay between the time the vacuum is applied to pull the document up to the feed belts and the start up of the belts to assure that the top sheet in the stack is captured before belt movement commences and to allow time for the air knife to separate sheet one from sheet two or any other sheets that were pulled up.

It should now be apparent that the separation capability of the vacuum corrugation feeder disclosed herein is highly sensitive to air knife pressure against a sheet stack as well as the amount of vacuum pressure directed against the top sheet in the stack. Disclosed herein is an improvement to the conventional vacuum corrugation top feeder and comprises a vacuum means without a valve that is ON from the beginning to the end of a copying run. This continuous negative pressure to the top of a stack of sheets allows faster throughput of copy sheets or documents through the feeder.

In addition to the method and apparatus disclosed above, other modifications and/or additions will readily appear to those skilled in the art upon reading this disclosure and are intended to be encompassed within the invention disclosed and claimed herein.

What is claimed is:

1. A high speed top sheet separator-feeder for separating and forwarding sheets including flimsy sheets seriatim from the top of a stack of sheets, comprising a stack tray for supporting a stack of sheets to be fed, endless vacuum belt means extending through at least the front end of the sheet stack tray for acquiring and advancing the top sheet of the stack, said vacuum belt means extending across a support surface having vacuum ports therein for positioning a negative pressure at the back of the belt means, and wherein the motion of said vacuum belt means is adapted to cease prior to the trail edge of the acquired sheet exposing all of said vacuum ports, air knife means positioned in front of the stack tray for applying air pressure to the sheets in the stack tray to separate the top sheet from the next adjacent sheet, and vacuum means for applying a continuous and uniform negative pressure to said vacuum ports during the feeding of sheets from the stack tray in order to increase the through put of said separator-feeder by acquiring the next sheet to be fed simultaneously with said cease of motion of said vacuum belt means such that said next sheet assumes a concaved appearance.

2. A high speed top sheet separator-feeder apparatus for separating and forwarding substrates including flimsy substrates in seriatim, comprising:

support means for supporting a stack of substrates, said support means having front, rear and side walls attached thereto, said rear and side walls overlapping the top of the stack;

air knife means located at the front of the substrate stack and adapted to apply air pressure to the stack in order to separate the top substrate of the stack from the next adjacent substrate;

vacuum means in position above the front edge of the stack for applying a vacuum with force sufficient to acquire the top substrate from the stack;

corrugation means for corrugating substrates as they are fed from the stack;

belt means entrained over said vacuum means and adapted to forward said substrates after they have been acquired by said vacuum means and wherein the forwarding of the substrates by said belt means ceases prior to the trail edge of an acquired substrate leaving said vacuum means; and means for continuously running said vacuum means with a constant and uniform negative pressure during an entire feeding of substrates from said support means such that the next substrate to be fed after the acquired substrate is captured while the forwarding of the acquired substrate has ceased.

3. A high speed top sheet separator-feeder for separating and forwarding sheets including flimsy sheets seriatim from the top of a stack of sheets, comprising a stack tray for supporting a stack of sheets to be fed, endless vacuum belt means extending through at least the front end of the sheet stack tray for acquiring and advancing the top sheet of the stack, said vacuum belt means extending across a support surface having vacuum ports therein for positioning a negative pressure at the back of the belt means, air knife means positioned in front of the stack tray for applying air pressure to the sheets in the stack tray to separate the top sheet from the next adjacent sheet, and vacuum means for applying a continuous and uniform negative pressure to said vacuum ports during the feeding of sheets from the stack tray in order to increase the through put of said feeder and wherein said vacuum belt means is stopped prior to the trail edge of the acquired sheet exposing all of the vacuum ports in said support surface in order to prevent multifeeding by allowing all sheets other than the next sheet to be fed to fall back on top of the stack.

4. The high speed feeder of claim 3, wherein the next sheet after the top sheet in said stack to be acquired by said vacuum belt means is first captured at a position between front and rear edges of said next sheet while the front and rear edges of said next sheet rest against the remaining sheets in the stack.

5. The high speed feeder of claim 4, wherein the center portion of said next sheet to be fed is the first area of said next sheet to be acquired by said vacuum belt means creating a concaved appearance in said next sheet before the top sheet has been fed completely from the stack tray.

6. The high speed feeder of claim 3, wherein the next sheet after the top sheet in said stack to be fed is acquired by said vacuum belt means as soon as the previously acquired sheet partially exposes said vacuum ports in said support surface.

7. The high speed feeder of claim 3, wherein the next sheet to be fed is acquired while simultaneously feeding the sheet previously acquired by said vacuum belt means.

8. A top sheet separator-feeder apparatus for separating and forwarding substrates including flimsy substrates in seriatim, comprising:

support means for supporting a stack of substrates, said support means having front, rear and side walls attached thereto, said rear and side walls overlapping the top of the stack;

air knife means located at the front of the substrate stack and adapted to apply air pressure to the stack in order to separate the top substrate of the stack from the next adjacent substrate;

vacuum means in position above the front edge of the stack for applying a vacuum with force sufficient to acquire the top substrate from the stack;

corrugation means for corrugating substrates as they are fed from the stack;

belt means entrained over said vacuum means and adapted to forward said substrates after they have been acquired by said vacuum means and;

means for continuously running said vacuum means with a constant and uniform negative pressure during an entire feeding of substrates from said support means such that after the top substrate in said stack has been acquired by said vacuum means the center portion of the next substrate to be fed is also acquired by said vacuum means while the front and rear portions of said next substrate to be fed rest upon the substrate stack until feeding of said top substrate has been accomplished.

* * * * *